US010235940B2

(12) United States Patent
Hu

(10) Patent No.: US 10,235,940 B2
(45) Date of Patent: Mar. 19, 2019

(54) PIXEL-DRIVING CIRCUIT, THE DRIVING METHOD THEREOF, AND DISPLAY DEVICE

(71) Applicants: BOE TECHNOLOGY GROUP CO., LTD., Beijing (CN); HEFEI XINSHENG OPTOELECTRONICS TECHNOLOGY CO., LTD., Anhui (CN)

(72) Inventor: Zuquan Hu, Beijing (CN)

(73) Assignees: BOE Technology Group Co., Ltd., Beijing (CN); Hefei Xinsheng Optoelectronics Technology Co., Ltd., Hefei (CN)

( * ) Notice: Subject to any disclaimer, the term of this patent is extended or adjusted under 35 U.S.C. 154(b) by 216 days.

(21) Appl. No.: 15/200,220

(22) Filed: Jul. 1, 2016

(65) Prior Publication Data

US 2017/0110056 A1 Apr. 20, 2017

(30) Foreign Application Priority Data

Oct. 19, 2015 (CN) ..... 2015 1 0680325

(51) Int. Cl.
*G09G 3/36* (2006.01)
*G09G 3/3258* (2016.01)

(52) U.S. Cl.
CPC ... *G09G 3/3258* (2013.01); *G09G 2300/0819* (2013.01); *G09G 2320/0233* (2013.01);
(Continued)

(58) Field of Classification Search
CPC .. G09G 3/30; G09G 3/36; G09G 3/20; G09G 3/22; G09G 5/00; G09G 3/10; G06F 3/038
See application file for complete search history.

(56) References Cited

U.S. PATENT DOCUMENTS

2011/0032243 A1 2/2011 Tsuji
2013/0088417 A1* 4/2013 Kim ..... G09G 3/3233 345/82
(Continued)

FOREIGN PATENT DOCUMENTS

CN 1577453 A 2/2005
CN 101937647 A 1/2011
(Continued)

OTHER PUBLICATIONS

Office Action from corresponding Chinese Application No. 201510680325.3, dated Mar. 13, 2017 (10 pages).

*Primary Examiner* — Pegeman Karimi
(74) *Attorney, Agent, or Firm* — Harness, Dickey & Pierce, P.L.C.

(57) ABSTRACT

The embodiment of present disclosure provides a pixel driving circuit and a driving method thereof and a display device, which can improve the undesirable phenomena of uneven display luminance of a display caused by a threshold voltage. The pixel driving circuit comprises a light emitting unit and at least one driving unit. The driving unit comprises a driving module, a compensation module and an initialization module. The light emitting unit is connected to the driving unit, a high level signal terminal, a low level signal terminal and a first signal terminal; the driving module is connected to the light emitting unit, a second signal terminal, the compensation module and the initialization module, respectively; the initialization module is connected to the light emitting unit, the driving module, the compensation module, an initial voltage terminal and a fourth signal terminal; the compensation module is connected to the driving module, the initialization module, a reference voltage terminal, a scanning signal terminal, a data voltage terminal and a third signal terminal. The driving unit further
(Continued)

comprises a first driving unit and a second driving unit for alternately driving two adjacent frames of image.

20 Claims, 5 Drawing Sheets

(52) U.S. Cl.
CPC . *G09G 2320/043* (2013.01); *G09G 2320/045* (2013.01); *G09G 2330/08* (2013.01)

(56) References Cited

U.S. PATENT DOCUMENTS

| | | | | |
|---|---|---|---|---|
| 2014/0111503 | A1* | 4/2014 | Kwon | G09G 3/3233 345/213 |
| 2014/0192101 | A1 | 7/2014 | Tsuge | |
| 2014/0333686 | A1* | 11/2014 | Kim | G09G 3/3233 345/694 |
| 2016/0042694 | A1* | 2/2016 | Lim | G09G 3/3233 345/78 |
| 2016/0322449 | A1* | 11/2016 | Pyon | H01L 27/3276 |

FOREIGN PATENT DOCUMENTS

| | | | |
|---|---|---|---|
| CN | 104021763 | A | 9/2014 |
| CN | 104157241 | A | 11/2014 |
| CN | 104299571 | A | 1/2015 |
| CN | 104464636 | A | 3/2015 |

* cited by examiner

PIXEL-DRIVING CIRCUIT, THE DRIVING METHOD THEREOF, AND DISPLAY DEVICE

CROSS-REFERENCE TO RELATED APPLICATION

This application claims the benefit and priority of Chinese Application No. 201510680325.3 filed Oct. 19, 2015. The entire disclosure of the above application is incorporated herein by reference.

FIELD

The present disclosure relates to the field of display technology, and particularly, to a pixel driving circuit, a driving method thereof and a display device.

BACKGROUND

This section provides background information related to the present disclosure which is not necessarily prior art.

With the fast development of display technology, the technology of a semiconductor element as the key of a display device has also been developed fast. For a conventional display device, an Organic Light Emitting Diode (OLED) as a current-type light emitting component, because of its self-emission, fast response, wide viewing angle, and being manufacturable on a flexible substrate and the like, is increasingly being used in the high performance display.

OLED can be divided into Passive Matrix Driving OLED (PMOLED) and Active Matrix Driving OLED (AMOLED) by the driving manner. Since an AMOLED display has advantages such as low manufacturing costs, high response speed, power saving, direct current drive adapted for portable devices, large operating temperature range, etc., it is expected to be a next generation new flat panel display replacing the liquid crystal display (LCD).

In a conventional AMOLED display panel, each OLED includes a plurality of Thin Film Transistor (TFT) switch circuits. However, characteristics of production process and polysilicon cause electrical parameters such as threshold voltage Vth, mobility, etc. to usually fluctuate in the production of the TFT switch circuits on a large-area glass substrate, so that current flowing through the OLED component in the AMOLED display panel not only changes with a ON-voltage stress generated when the TFTs have been turned on for a long time, but also vary with the drift of the threshold voltage Vth of the TFTs. This will affect luminance uniformity and luminance constancy of the display, thereby reducing picture performance and quality of the display.

SUMMARY

This section provides a general summary of the disclosure, and is not a comprehensive disclosure of its full scope or all of its features.

The embodiments of present disclosure provides a pixel driving circuit and a driving method thereof and a display device, which can improve the undesirable phenomena of uneven display luminance caused by a threshold voltage.

In an aspect of an embodiment of the present disclosure, there is provided a pixel driving circuit comprising a light emitting unit and at least one driving unit, the driving unit comprising a driving module, a compensation module and an initialization module, wherein the light emitting unit is connected to the driving unit, a high level signal terminal, a low level signal terminal and a first signal terminal, respectively, and is configured to emit light under the control of the driving unit, the high level signal terminal, the low level signal terminal and the first signal terminal;

the driving module is connected to the light emitting unit, the compensation module, the initialization module and a second signal terminal, respectively, and is configured to drive the light emitting unit to emit light under the control of the second signal terminal;

the initialization module is connected to the light emitting unit, the driving module, the compensation module, an initial voltage terminal and a fourth signal terminal, respectively, and is configured to initiate the driving module via the initial voltage terminal under the control of the fourth signal terminal;

the compensation module is connected to the driving module, the initialization module, a reference voltage terminal, a scanning signal terminal, a data voltage terminal and a third signal terminal, respectively, and is configured to compensate a threshold voltage of the driving module under the control of the reference voltage terminal, the scanning signal terminal, the data voltage terminal and the third signal terminal.

According to a further embodiment of the present disclosure, the light emitting unit includes a light emitting component and a first switching component, wherein the anode of the light emitting component is coupled to the high level signal terminal and connected to the driving module, and the cathode of the light emitting component is connected to the driving module;

the control electrode of the first switching component is coupled to the first signal terminal, the first electrode of the first switching component is coupled to the low level signal terminal, and the second electrode of the first switching component is connected to the driving module.

According to a further embodiment of the present disclosure, the driving module comprises a second driving component and a third switching component, the control electrode of the second driving component is connected to the compensation module, the first electrode of the second driving component is coupled to the second electrode of the third switching component and the cathode of the light emitting component, respectively, and the second electrode of the second driving component is connected to the initialization module;

the control electrode of the third switching component is coupled to the second signal terminal, and the first electrode of the third switching component is coupled to the high level signal terminal and the anode of the light emitting component, respectively.

According to a further embodiment of the present disclosure, the compensation module comprises a fourth switching component, a fifth switching component, a sixth switching component and an energy storage element, the control electrode of the fourth switching component is coupled to the scanning signal terminal and the control electrode of the fifth switching component, respectively, the first electrode of the fourth switching component is coupled to the data voltage terminal, and the second electrode of the fourth switching component is coupled to the first electrode of the energy storage element and the second electrode of the sixth switching component, respectively;

the first electrode of the fifth switching component is coupled to the reference voltage terminal, the second electrode of the fifth switching component is coupled to the first electrode of the sixth switching component and connected to the control electrode of the second driving component in the driving module;

the control electrode of the sixth switching component is coupled to the third signal terminal;

the second electrode of the energy storage element is coupled to the second electrode of the second driving component in the driving module and is connected to the initialization module.

According to a further embodiment of the present disclosure, the initialization module includes a seventh switching component, the control electrode of the seventh switching component is coupled to a fourth signal terminal, the first electrode of the seventh switching component is connected to the driving module and the compensation module, respectively, and the second electrode of the seventh switching component is coupled to the initial voltage terminal.

According to a further embodiment of the present disclosure, the light emitting component is an organic light emitting diode.

According to another aspect of the present disclosure, there is provided a display device comprising the pixel driving circuit described above.

According to another aspect of the present disclosure, there is provided a method for driving the pixel driving circuit described above, the method comprising the following steps:

in the first phase of displaying each frame of image, turning on the initialization module to initiate the driving module and the compensation module;

in the second phase of displaying each frame of image, the initialization module being turned off and the compensation module compensating the threshold voltage of the driving module;

in the third phase of displaying each frame of image, the initialization module being turned off and the driving module driving the light emitting unit to emit light.

According to a further embodiment of the present disclosure, the pixel driving circuit comprises two driving modules, the light emitting unit is connected to a first driving unit and a second driving unit of the two driving units, a high level signal terminal, a low level signal terminal and a first signal terminal, respectively, and is configured to emit light under the control of the first and second driving units, the high level signal terminal, the low level signal terminal and the first signal terminal;

the driving modules of the first and second driving units are connected to the respective second signal terminal, the initialization modules of the first and second driving units are connected to the respective fourth signal terminal, the compensation modules of the first and second driving units are connected to the respective scanning signal terminal, data signal terminal, and third signal terminal;

the first driving unit is configured to drive the light emitting unit to emit light during displaying the N-th frame of image;

the second driving unit is configured to drive the light emitting unit to emit light during displaying the N+1st frame of image;

where, N is a natural number, and the N-th frame of image and the first N+1st frame of image are two adjacent frames of image.

According to another aspect of the present disclosure, there is provided a pixel driving circuit comprising a light emitting unit, a first driving unit and a second driving unit, each of the first driving unit and the second driving unit comprising a driving module, a compensation module and an initialization module, respectively, wherein the light emitting unit is connected to the first driving unit and the second driving unit, a high level signal terminal, a low level signal terminal and a first signal terminal, respectively, and emits light under the control of the first driving unit and the second driving unit, the high level signal terminal, the low level signal terminal and the first signal terminal;

the driving module, the compensation module and the initialization module in each of the first driving unit and the second driving unit have the same structure as the driving module, the compensation module and the initialization module of the driving unit as described above;

the first driving unit is configured to drive the light emitting unit to emit light during displaying the N-th frame of image;

the second driving unit is configured to drive the light emitting unit to emit light during displaying the N+1st frame of image;

wherein, N is a natural number, and the N-th frame of image and the N+1st frame of image are two adjacent frames of image.

According to a further embodiment of the present disclosure, the light emitting component is an organic light emitting diode.

According to another aspect of the present disclosure, there is provided a display device comprising the pixel driving circuit as described above.

According to another aspect of the present disclosure, there is provided a method for driving the pixel driving circuit described above, the method comprising the following steps:

in the first phase of displaying the N-th frame of image, turning on the initialization module of the first driving unit to initiate the driving module of the first driving unit and the compensation module of the first driving unit;

in the second phase of displaying the N-th frame of image, the initialization module of the first driving unit being turned off and the compensation module of the first driving unit compensating the threshold voltage of the driving module of the first driving unit;

in the third phase of displaying the N-th frame of image, the initialization module of the first driving unit being turned off and the driving module of the first driving unit driving the light emitting unit to emit light;

in the first phase of displaying the N+1st frame of image, turning on the initialization module of the second driving unit to initiate the driving module of the second driving unit and the compensation module of the second driving unit;

in the second phase of displaying the N+1st frame of image, the initialization module of the second driving unit being turned off and the compensation module of the second driving unit compensating the threshold voltage of the driving module of the second driving unit;

in the third phase of displaying the N+1st frame of image, the initialization module of the second driving unit being turned off and the driving module of the second driving unit driving the light emitting unit to emit light.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

REFERENCE SIGNS

Figure 1:
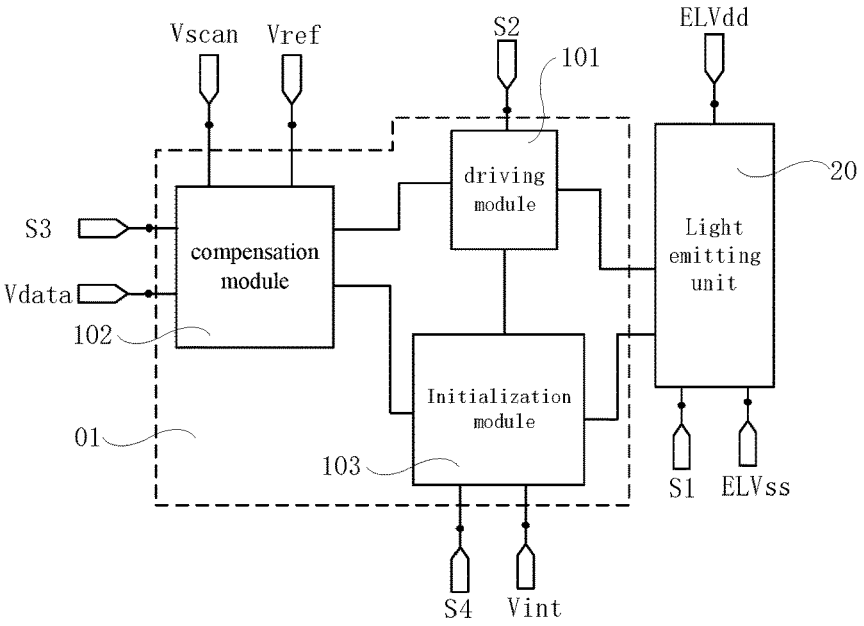
FIG. 1 is an exemplary block diagram of a first pixel driving circuit according to an embodiment of the present disclosure.

01—driving unit; 10—first driving unit; 11—second driving unit; 101—driving module; 102—compensation module; 103—initialization module; 20—light emitting unit.

Corresponding reference numerals indicate corresponding parts or features throughout the several views of the drawings.

DETAILED DESCRIPTION

Example embodiments will now be described more fully with reference to the accompanying drawings.

Those skilled in the art would appreciate that the terms used herein are only for the purpose of describing particular embodiments and are not intended to limit the disclosure. As used herein, the singular forms "a", "an" and "the" are intended to comprise the plural forms as well, unless expressly stated in other cases. It should be further understood that when the terms "include", "comprise", "including" and/or "comprising" are used in this specification, they refer to the elements, parts, modules and/or units that exist but do not exclude the presence or addition of one or more other elements, parts, modules and/or combinations thereof.

Unless otherwise defined, all terms (comprising technical and scientific terms) used herein have the same meaning commonly understood by those skilled in the art where the disclosed subject matter belongs. It will be further understood that terms, such as those defined in commonly used dictionaries, should be interpreted as the meanings consistent with their meanings in the context of the description and the related art, and will not be explained in an idealized or overly formal form, unless otherwise explicitly defined herein. As used herein, the statement "connecting" or "coupling" two or more parts together shall mean that the parts are directly combined together or combined through one or more intermediate components.

In all embodiments of the present disclosure, the switching elements and the driving elements employed are illustrated by example of N-type (MOS) Field Effect Transistor (FET), and also may adopt P-type FETs, and P-type or N-type Bipolar Junction Transistors (BJT) to implement the functions of the switching elements and the driving elements. Since source and drain of a transistor (emitter and collector) are symmetrical, and a P-type transistor and a N-type transistor have opposite directions of conduction current between source and drain (emitter and collector), in the embodiments of the present disclosure, it is specified that a controlled intermediate terminal of a transistor is the gate, a signal input terminal is the source, and a signal output terminal is the drain. Further, any controlled switching device with gating signal input may be adopted to implement the functions of the switching elements, the controlled intermediate terminal of the switching device for receiving a control signal (for example, for turning on and off the controlled switching device) being called a control electrode, the signal input terminal being called the first electrode, and the signal output terminal being called the second electrode. The transistors employed in the embodiments of the present disclosure are primarily switching transistors and driving transistors. Further, the capacitor employed in the embodiment of the present disclosure also may adopt an energy storage element having a similar function.

FIG. 1 is an exemplary block diagram of a first pixel driving circuit according to an embodiment of the present disclosure. The first pixel driving circuit comprises at least one driving unit 01 and a light emitting unit 20. The driving unit 01 may include a driving module 101, a compensation module 102 and an initialization module 103.

The light emitting unit 20 is connected to the driving unit 01, a high level signal terminal ELVdd, a low level signal terminal ELVss and a first signal terminal S1 for the gate driving of an OLED component, respectively, and is configured to emit light under the control of the driving unit 01, the high level signal terminal ELVdd, the low level signal terminal ELVss and the first signal terminal S1. The light emitting unit 20 is connected to the driving unit 01 by connecting to the driving module 101 and the initialization module 103 respectively. The voltage of the high level signal terminal ELVdd is higher than the voltage of the low level signal terminal ELVss, and the low level signal terminal ELVss may also be grounded.

The driving module 101 is connected to the light emitting unit 20, the compensation module 102, the initialization module 103 and a second signal terminal S2, respectively, and is configured to drive the light emitting unit 20 to emit light under the control of the second signal terminal S2.

The initialization module 103 is connected to the light emitting unit 20, the driving module 101, the compensation module 102, an initial voltage terminal Vint and a fourth signal terminal S4, respectively, and is configured to initiate the driving module 101 via the initial voltage terminal Vint under the control of the fourth signal terminal S4.

The compensation module 102 is connected to the driving module 101, the initialization module 103, a reference voltage terminal Vref, a scanning signal terminal Vscan, a data voltage terminal Vdata and a third signal terminal S3, respectively, and is configured to compensate a threshold voltage Vth of the driving module 101 under the control of the reference voltage terminal Vref, the scanning signal terminal Vscan, the data voltage terminal Vdata and the third signal terminal S3.

Figure 2:
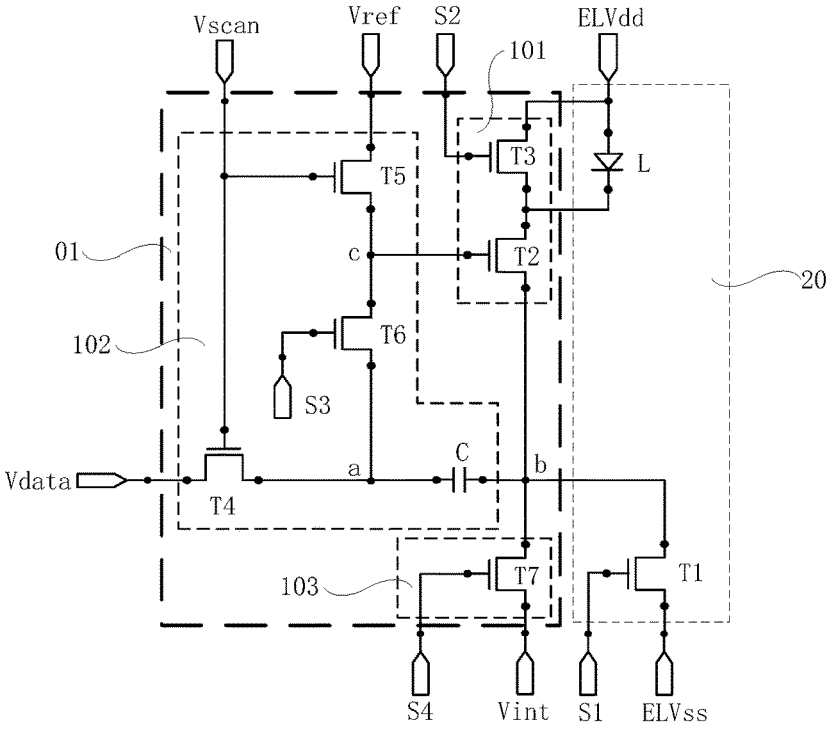
FIG. 2 is an exemplary circuit of the first pixel driving circuit according to the embodiment of the present disclosure.

FIG. 2 is an exemplary circuit of the first pixel driving circuit shown in FIG. 1.

The light emitting unit 20 includes a light emitting component L and a first transistor T1.

The anode of the light emitting component L is coupled to the high level signal terminal ELVdd and connected to the driving module 101, and the cathode of the light emitting component L is connected to the driving module 101. The light emitting component L may be a variety of current-driven light emitting components comprising an LED or an OLED, and is described by example of OLED in embodiments of the present disclosure.

The control electrode of the first transistor T1 is coupled to the first signal terminal S1, the first electrode of the first transistor T1 is coupled to the low level signal terminal ELVss, and the second electrode of the first transistor T1 is connected to the driving module 101.

Respective modules of the driving unit 01 are described below in detail.

The driving module 101 of the driving unit 01 comprises a second driving transistor T2 for controlling the operating state of the light emitting unit L and a third transistor T3. The control electrode of the second transistor T2 is connected to the compensation module 102, the first electrode of the second driving transistor T2 is coupled to the second electrode of the third transistor T3 and the cathode of the light emitting component L in the light emitting unit 20, respectively, and the second electrode of the second driving transistor T2 is connected to the compensation module 102 and the initialization module 103, respectively. The control electrode of the third transistor T3 is coupled to the second signal terminal S2, and the first electrode of the third transistor T3 is coupled to the high level signal terminal ELVdd and the anode of the light emitting component L, respectively.

The compensation module 102 comprises a fourth switching component T4, a fifth transistor T5, a sixth transistor T6 and a capacitor C. Wherein, the control electrode of the fourth transistor T4 is coupled to the scanning signal terminal Vscan and the control electrode of the fifth transistor T5, respectively, the first electrode of the fourth transistor T4 is coupled to the data voltage terminal Vdata, and the second electrode of the fourth transistor T4 is coupled to the first electrode of the capacitor C and the second electrode of the sixth transistor T6, respectively, via the node a. The first electrode of the fifth transistor T5 is coupled to the reference voltage terminal Vref, the second electrode of the fifth transistor T5 is coupled to the first electrode of the sixth transistor and connected to the driving module 101. The control electrode of the sixth transistor T6 is coupled to the third signal terminal S3. The second electrode of the capacitor C is coupled to the driving module 101. Wherein, when the structure of the driving module 101 is as described above, the second terminal of the storage capacitor C is coupled to the second electrode of the second driving transistor T2 in the driving module 101, the first electrode of the first transistor T1 in the light emitting unit 20 and the initialization module 103; the second electrode of the fifth transistor and the first electrode of the sixth transistor are coupled to the control electrode of the second driving transistor T2 in the driving unit 101.

The initialization module 103 includes a seventh transistor T7. The control electrode of the seventh transistor T7 is coupled to a fourth signal terminal S4, the first electrode of the seventh transistor T7 is coupled to the second electrode of the second driving transistor T2 of the driving module 101, the second electrode of the capacitor C in the compensation module 102 and the first electrode of the first transistor T1 in the light emitting unit 20, respectively, via node b, and the second electrode of the seventh transistor T7 is coupled to the initial voltage terminal Vint.

Figure 3:
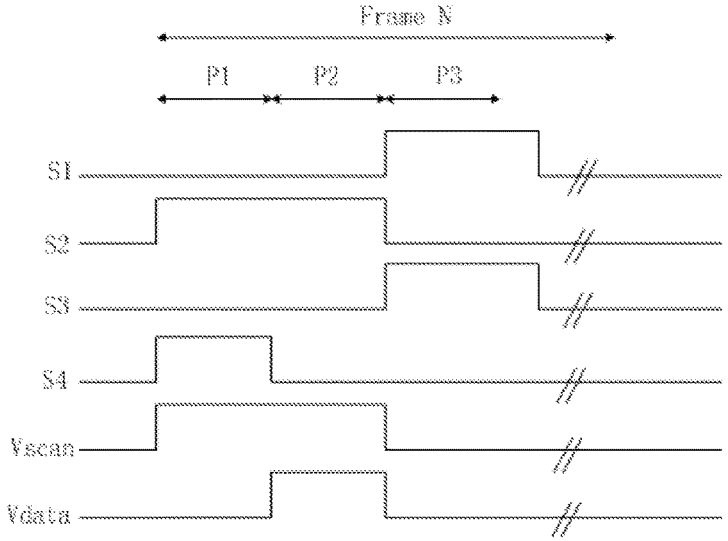
FIG. 3 is a signal timing chart of the first pixel driving circuit in operation according to the embodiment of the present disclosure.

FIG. 3 shows a flowchart of the displaying process of each frame of image of the first pixel driving circuit according to the embodiment of the present disclosure. The displaying process of displaying the N-th frame of image can be divided into a first phase P1, a second phase P2, and a third phase P3, where N is a natural number.

In the first phase (initialization phase) P1, S1 is at low level, S2 is at high level, S3 is at low level, S4 is at high level, Vscan is at high level, Vdata is at low level.

The first signal terminal S1 is at low level, the first transistor T1 is turned off. The second signal terminal S2 is at high level, the third transistor T3 is turned on. Since the first electrode and the second electrode of the third transistor T3 are coupled to the anode and cathode of the light emitting component L, respectively, the light emitting component L is short-circuited, and is in a non-luminous state.

The scanning signal terminal Vscan is at high level so that the fourth transistor T4 and the fifth transistor T5 are turned on. The third signal terminal S3 is at low level, so that the sixth transistor T6 is turned off. At this time, the data signal of the data voltage terminal Vdata is outputted to node a via the fourth transistor T4; the reference voltage of the reference voltage terminal Vref is outputted to node c via the fifth transistor T5, that is, the control electrode of the second driving transistor T2. The fourth signal terminal S4 is at high level, the seventh transistor T7 is turned on such that the voltage of the initial voltage terminal Vint is outputted to the node b via the seventh transistor, that is, the second electrode of the second driving transistor T2. In this case, the reference voltage of the reference voltage terminal Vref is greater than the sum of the absolute value of the threshold voltage Vth of the second driving transistor T2 and the initial voltage of the initial voltage terminal Vint, i.e. $Vref>|Vth|+Vint$, such that the second driving transistor T2 is turned on.

The purpose of the initialization phase is to turn on the second driving transistor T2, to prepare the compensation of the threshold voltage Vth of the second driving transistor T2 in the subsequent step.

In the second phase (threshold voltage compensation phase) P2, S1 is at low level, S2 is at high level, S3 is at low level, S4 is at low level, Vscan is at high level, Vdata is at high level.

The first signal terminal S1 is at low level, the first transistor T1 is turned off. The second signal terminal S2 is at high level, the third transistor T3 is turned on, whereby the light emitting component L is short-circuited, and is in a non-luminous state.

The fourth signal terminal S4 is at low level, the seventh transistor is turned off, so that the voltage of the second electrode of the capacitor C (i.e. voltage at node b) remains unchanged. The third signal terminal S3 is at low level, the sixth transistor is turned off.

The scanning signal terminal Vscan is at high level so that the fifth transistor T5 is turned on. The reference voltage of the reference voltage terminal Vref is outputted to the node c via the fifth transistor T5, that is, the control electrode of the second driving transistor T2. Because the nodes b and c remain the voltage in the last phase, the second driving transistor T2 is kept being turned on, the capacitor C continues to be charged until the voltage of the node b $Vb=Vref-Vth$.

The scanning signal terminal Vscan is at high level, the fourth transistor T4 is turned on, so that the data signal of the data voltage terminal Vdata is outputted to the node a via the fourth transistor T4, whereby the voltage of the node a Va=Vdata.

At this time, the voltage difference between the two electrodes of the capacitor C is Va−Vb=Vdata−Vref+Vth.

The purpose of the threshold voltage compensation phase is to compensate the threshold voltage of the second driving transistor T2, and writes the data signal input via the data voltage terminal Vdata.

In the third phase (light emitting phase) P3, S1 is at high level, S2 is at low level, S3 is at high level, S4 is at low level, Vscan is at low level, Vdata is at low level.

The first signal terminal S1 is at high level, the first transistor T1 is turned on. The scanning signal terminal Vscan is at low level, the fourth transistor T4 and the fifth transistor T5 are turned off. The third signal terminal S3 is at high level, the sixth transistor T6 is turned on, so that the nodes c and a are conducted. The fourth signal terminal S4 is at low level, the seventh transistor is turned off, so that the voltage of the second electrode of the capacitor C (i.e., voltage at node b) remains unchanged. The gate-source voltage Vgs of the second driving transistor T2 remains the value at the end of the last phase P2, that is Vgs=Vc−Vb=Va−Vb=Vdata−Vref+Vth.

When the value of the gate-source voltage Vgs of the second driving transistor T2 minus the threshold voltage Vth of the second driving transistor T2 is less than or equal to the drain-source voltage Vds of the second driving transistor T2, i.e. Vgs−Vth t Vds, the second driving transistor T2 is in a saturated ON state, and at the time, the driving current I flowing through the second driving transistor T2 is:

$$I=K(Vgs-Vth)^2=K(V\text{data}-V\text{ref}+Vth-Vth)^2=K(V\text{data}-V\text{ref})^2 \quad (1)$$

Where, K is a current constant related to process parameters and geometric dimensions of the second driving transistor T2.

The threshold voltage Vth between different pixel units is generally not the same, and the threshold voltage Vth of the same pixel unit may also drift over time, resulting in display luminance difference. It can be seen from the formula (1) that the driving current I for driving the light emitting unit L to emit light is irrelevant to the threshold voltage Vth of the second driving transistor T2, so as to eliminate the impact of the threshold voltage Vth of the driving transistor on the luminance of the light emitting unit L, enhance uniformity and constancy of luminance of the light emitting component of the pixel unit, and improve the undesirable phenomena of uneven display luminance of the display caused by the threshold voltage.

The purpose of the light emitting phase is to drive the light emitting component L to emit light, wherein the driving current I is irrelevant to the threshold voltage Vth of the second driving transistor T2.

Figure 4:
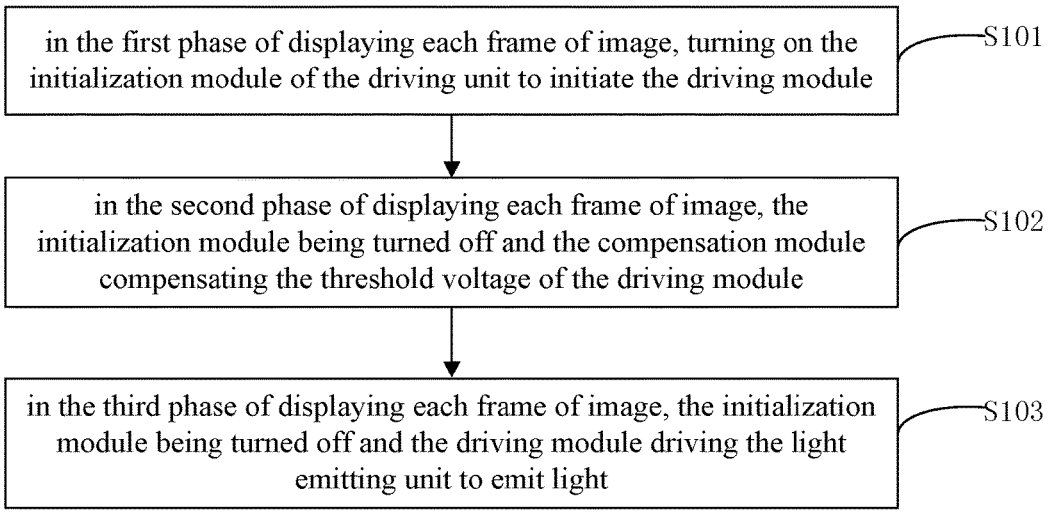
FIG. 4 is a work flowchart of the first pixel driving circuit according to the embodiment of the present disclosure.

FIG. 4 is a work flowchart of the first pixel driving circuit according to the embodiment of the present disclosure.

In step S101 corresponding to the first phase P1 in FIG. 3, the initialization module 103 of the driving unit 01 is turned on, to initiate the driving module 101 and the compensation module 102;

in step S102 corresponding to the second phase P2 in FIG. 3, the initialization module 103 is turned off, and the compensation module 102 compensates the threshold voltage of the driving module 101;

in step S103 corresponding to the third phase P3 in FIG. 3, the initialization module 103 is turned off, the driving module 101 drives the light emitting unit 20 to emit light.

When the light emitting unit 20 emits light, driven by the driving unit 01 according to the embodiment of the present disclosure, the driving unit 01 is kept being in operation state, so that the driving transistor DTFT in the driving unit 01, for example, the second driving transistor T2 is kept being in the gate-biasing state for a long time, accelerating the decay rate of the driving transistor DTFT and shortening its life.

Further, the another embodiment of the present disclosure provides a second pixel driving circuit, with at least one second driving unit added on the basis of the first pixel driving circuit.

Figure 5:
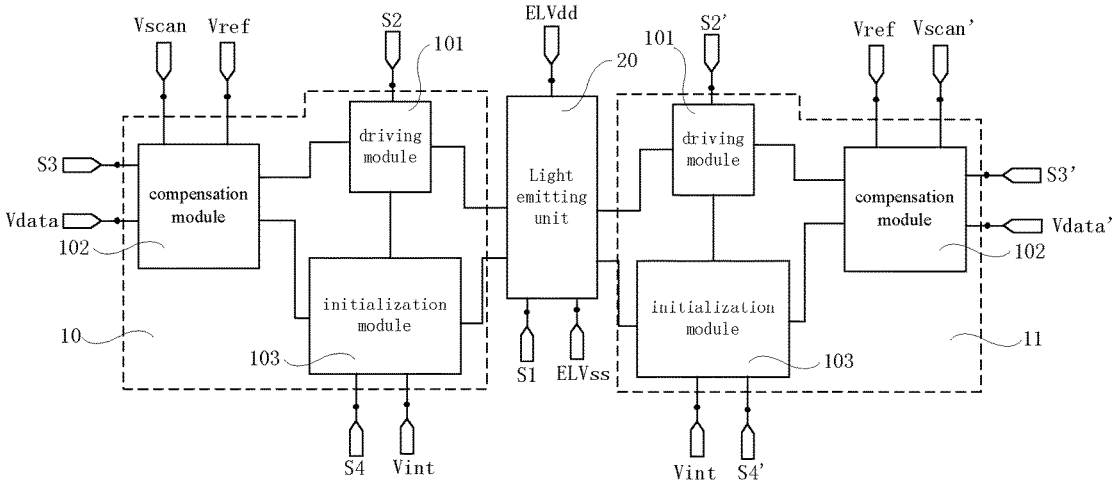
FIG. 5 is an exemplary block diagram of a second pixel driving circuit according to another embodiment of the present disclosure.

FIG. 5 shows an exemplary block diagram of a second pixel driving circuit having two driving units. The second pixel driving circuit comprises a first driving unit 10 and a second driving unit 11. Wherein, the first driving unit 10 is configured to drive the light emitting unit 20 to emit light when displaying an N-th frame of image. The second driving unit 11 is configured to drive the light emitting unit 20 to emit light when displaying the subsequent neighboring N+1st frame of image. Thus, the first driving unit 10 and the second driving unit 11 may alternately drive the light emitting unit 20 to emit light when displaying two adjacent frames of image, thereby preventing a driving transistor DTFT in a single driving unit from being in gate-biasing state for a long time, and extending the life of DTFT.

The first driving unit 10 and the second driving unit 11 have the same layout structure, and are arranged symmetrically with respect to the light emitting unit 20. The light emitting unit 20 and the first driving unit 10 are completely the same as the first light emitting unit 20 and the driving unit 01 in the first pixel driving circuit shown in FIG. 1. The second driving unit 11 is different from the first driving unit 10 only in that the driving module 101 of the second driving unit 11 is connected to the second signal terminal S2', the compensation module 102 is connected to the third signal terminal S3' and the data voltage terminal Vdata', respectively, and initialization module 103 is connected to the fourth signal terminal S4'. The light emitting unit 20 is connected to the first driving unit 10 and the second driving unit 11 in parallel, respectively. Other same modular structure and connection relationship are omitted.

Figure 6:
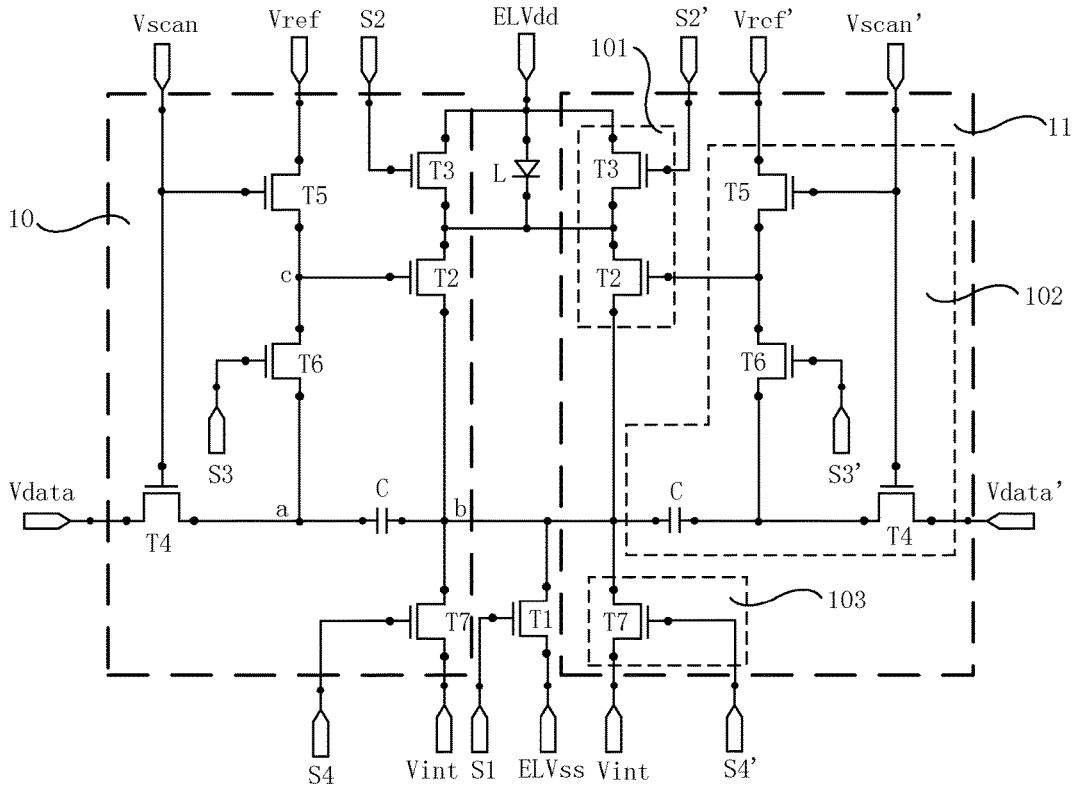
FIG. 6 is an exemplary circuit of the second pixel driving circuit according to the another embodiment of the present disclosure.

FIG. 6 shows an exemplary circuit of the second pixel driving circuit according to another embodiment of the present disclosure. The light emitting unit 20, the first driving unit 10 and the second driving unit 11 have circuit components and structures which are completely same as the corresponding portion in the first pixel driving circuit shown in FIG. 2, thus follow the reference signs in FIG. 2. Wherein the positive electrode of the light emitting component L of the light emitting unit 20 is coupled to the first electrode of the third transistor T3 in the driving module of the first driving unit 10 and the first electrode of the third transistor T3 in the driving module of the second driving unit 11, respectively, and the negative electrode of the light emitting component L is coupled to the second electrode of the third transistor T3 and the first electrode of the second driving transistor T2 in the driving module of the first driving unit 10, and the second electrode of the third transistor T3 and the first electrode of the second driving transistor T2 in the driving module of the second driving unit 11, respectively; the first electrode of the first transistor T1 is coupled to the second electrode of the second driving transistor T2 and the second electrode of the capacitor C in the compensation module in the driving module of the first driving unit 10, and the second electrode of the second driving transistor T2 and the second electrode of the capacitor C in the compensation module in the driving module of the second driving unit 11, respectively. Other same modular structure and connection relationship are omitted.

Figure 7:
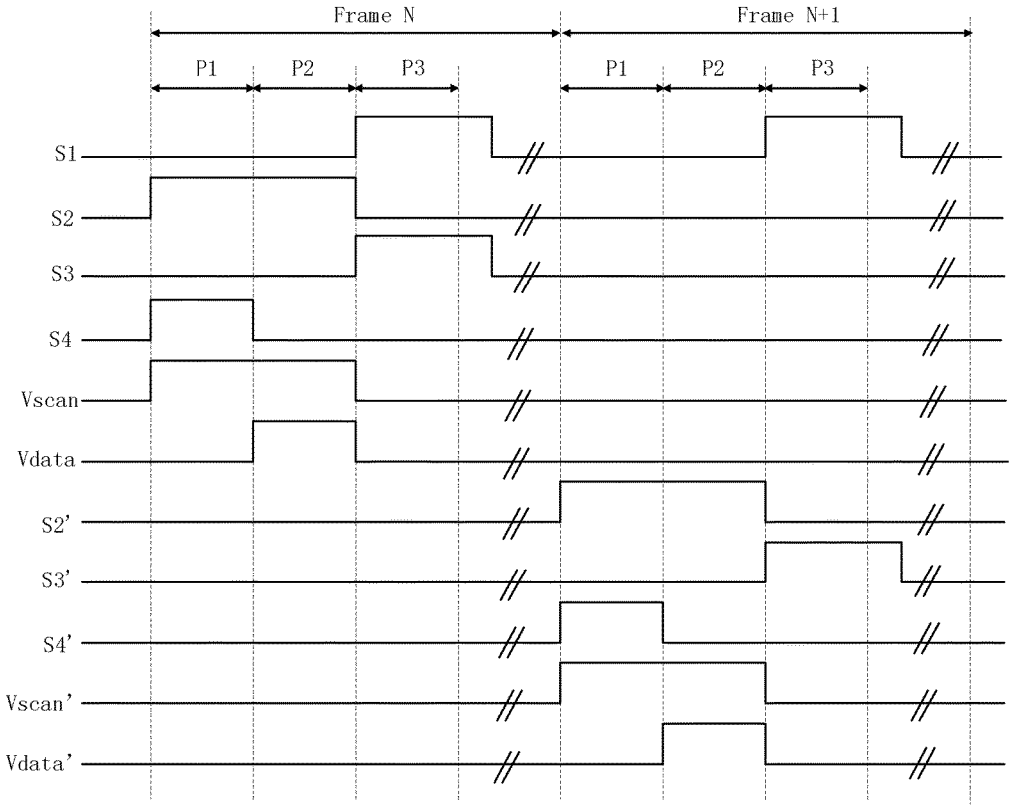
FIG. 7 is a signal timing chart of the second pixel driving circuit in operation according to the another embodiment of the present disclosure.
Figure 8:
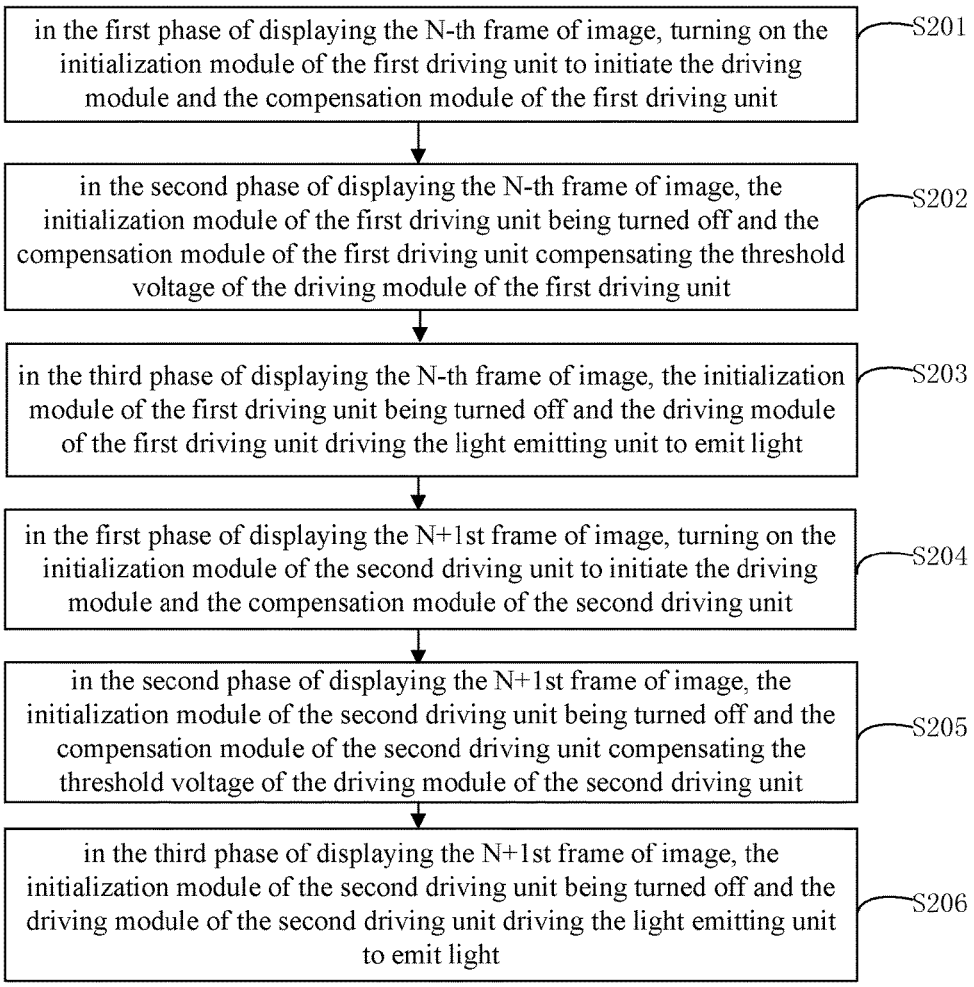
FIG. 8 is a work flowchart of the second pixel driving circuit according to the another embodiment of the present disclosure.

The displaying process of the second pixel driving circuit displaying each frame of image according to another embodiment of the present disclosure is now described in conjunction with FIG. 7 and FIG. 8.

FIG. 7 shows a flow chart of the displaying process of the second pixel driving circuit displaying the N-th frame of image and the N+1st frame of image, where N is a natural number. The displaying process of displaying each frame of image is divided into a first phase P1, a second phase P2, and a third phase P3. Wherein in the three phases of the N-th frame of image, ST to S4' and Vscan' and Vdata' are at low levels, so that the second driving unit 11 does not operate in the driving phase of displaying the frame of image, ant in the three phases of the N+1st frame of image, S2 to S4 and Vscan and Vdata are at low levels, so that the first driving unit 10 does not operate in the driving phase of displaying the frame of image. S1 is at high level in the corresponding third phase P3 during the displaying process of two adjacent frames of image, so that the display component L is capable of displaying each frame of image.

In the first phase (initialization phase) P1 of the N-th frame of image, S1 is at low level, S2 is at high level, S3 is at low level, S4 is at high level, Vscan is at high level, Vdata is at low level.

The timing of respective signals of the first driving unit 10 is the same as the timing of signals of the driving unit 01 in the first pixel driving circuit, whereby the state of each transistor and driving transistor of the first driving unit 10 is the same as for the driving unit 01 in the first pixel driving circuit. The respective signals of the second driving unit 11 are at low levels, which is equivalent to the second driving unit 11 not operating in the first phase. Therefore, in the first phase of the N-th frame of image, the second pixel driving circuit uses only the first driving unit 10, and similar to the driving unit 01 in the first pixel driving circuit, turns on the second driving transistor T2 in the first driving unit 10, to prepare the compensation of the threshold voltage Vth of the second driving transistor T2 in a subsequent step.

In the second phase (threshold voltage compensation phase) P2 of the N-th frame of image, S1 is at low level, S2 is at high level, S3 is at low level, S4 is at low level, Vscan is at high level, and Vdata is at high level. Similar to the second phase P2 using the first pixel driving unit to display the N-th frame of image, the first driving unit 10 compensates the threshold voltage of the second driving transistor T2, and writes the data signal input at the data voltage terminal Vdata.

In the third phase (light emitting phase) P3 of the N-th frame of image, S1 is at high level, S2 is at low level, S3 is at high level, S4 is at low level, Vscan is at low level, Vdata is at low level. Similar to the third phase P3 using the first pixel driving unit to display the N-th frame of image, the first driving unit 10 drives the light emitting component L to emit light, wherein referring to the formula (1), the driving current I is irrelevant to the threshold voltage Vth of the second driving transistor T2.

In the first phase (initialization phase) P1 of the N+1st frame of image, S1' is at low level, ST is at high level, S3' is at low level, S4' is at high level, Vscan' is at high flat, and Vdata' is at low level.

The timing of respective signals of the second driving unit 11 is the same as the timing of signals of the driving unit 01 in the first pixel driving circuit, whereby the state of each transistor and driving transistor of the second driving unit 11 is the same as for the driving unit 01 in the first pixel driving circuit. The respective signals of the first driving unit 10 are at low levels, which is equivalent to the first driving unit 10 not operating in the first phase. Therefore, in the first phase of the N+1st frame of image, the second pixel driving circuit uses only the second driving unit 11, and similar to the driving unit 01 in the first pixel driving circuit, turns on the second driving transistor T2 in the second driving unit 11, to prepare the compensation to the threshold voltage Vth of the second driving transistor T2 in a subsequent step.

In the second phase (threshold voltage compensation phase) P2 of the N+1st frame of image, S1 is at low level, S2 is at high level, S3 is at low level, S4 is at low level, Vscan is at high level, and Vdata is at high level Similar to the second phase P2 using the first pixel driving unit to display the N-th frame of image, the second driving unit 11 compensates the threshold voltage of the second driving transistor T2, and writes the data signal input at the data voltage terminal Vdata.

In the third phase (light emitting phase) P3 of the N+1st frame of image, S1 is at high level, S2 is at low level, S3 is at high level, S4 is at low level, Vscan is at low level, Vdata is at low level. Similar to the third phase P3 using the first pixel driving unit to display the N-th frame of image, the second driving unit 11 drives the light emitting component L to emit light, wherein referring to the formula (1), the driving current I is irrelevant to the threshold voltage Vth of the second driving transistor T2.

After the first driving unit 10 and the second driving unit 11 alternately drive the light emitting unit 20 to emit light, only the driving transistor DTFT in one driving unit operates during the displaying of each frame of image, thus preventing the driving transistor DTFT in the single driving unit from being in gate-biasing state for a long time, and extending the life time of DTFT.

FIG. 8 shows a work flowchart of the second pixel driving circuit according to another embodiment of the present disclosure.

In step S201 corresponding to the first phase P1 of displaying the N-th frame of image in FIG. 7, the initialization module 103 of the first driving unit 10 is turned on, to initiate the driving module 10 and the compensation module 102 of the first driving unit 101;

in step S202 corresponding to the second phase P2 of displaying the N-th frame of image in FIG. 7, the initialization module 103 of the first driving unit 10 is turned off, the compensation module 102 of the first driving unit 10 compensates the threshold voltage of the driving module 101;

in step S203 corresponding to the third phase P3 of displaying the N-th frame of image in FIG. 7, the initialization module 103 of the first driving unit 10 is turned off, and the driving module 101 of the first driving unit 10 drives the light emitting unit 20 to emit light;

in step S204 corresponding to the first phase P1 of displaying the N+1st frame of image in FIG. 7, the initialization module 103 of the second driving unit 11 is turned on, to initiate the driving module 101 and the compensation module 102 of the second driving unit 11;

in step S205 corresponding to the second phase P2 of displaying the N+1st frame of image in FIG. 7, the initialization module 103 of the second driving unit 11 is turned off, and the compensation module 102 of the second driving unit 11 compensates the threshold voltage of the driving module 101;

in step S206 corresponding to the third phase P3 of displaying the N+1st frame of image in FIG. 7, the initialization module 103 of the second driving unit 11 is turned off, and the driving module 101 of the second driving unit 11 drives the light emitting unit 20 to emit light.

The embodiment of present disclosure further provides a display device comprising any one of the pixel driving circuits as described above. The display device may include an array composed of a plurality of pixel units, each pixel unit comprising any one of the pixel driving circuits as described above. The display device has the same beneficial effects as the pixel driving circuit provided in the aforementioned embodiments of the present disclosure, which will not be mentioned here. The display device may be a display device having a current-driven light emitting component including an LED or OLED.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A pixel driving circuit comprising a light emitting unit and at least one driving unit including a driving module, a compensation module and an initialization module;

wherein the light emitting unit is connected to the at least one driving unit, a high level signal terminal, a low level signal terminal and a first signal terminal, and is configured to emit light under the control of the driving unit, the high level signal terminal, the low level signal terminal and the first signal terminal;

wherein the driving module is connected to the light emitting unit, the compensation module, the initialization module and a second signal terminal, and is configured to drive the light emitting unit to emit light under the control of the second signal terminal;

wherein the initialization module is connected to the light emitting unit, the driving module, the compensation module, an initial voltage terminal and a fourth signal terminal, and is configured to initiate the driving module via the initial voltage terminal under the control of the fourth signal terminal; and wherein the compensation module is connected to the driving module, the initialization module, a reference voltage terminal, a scanning signal terminal, a data voltage terminal and a third signal terminal, and is configured to provide a reference voltage from the reference voltage terminal to the driving module under the control of the scanning signal terminal, store a data voltage from the data voltage terminal under the control of the scanning signal terminal, and provide the stored data voltage to the driving module under the control of the third signal terminal.

2. The pixel driving circuit according to claim 1, wherein the light emitting unit includes a light emitting component having an anode and a cathode, and a first switching component having a first electrode, a second electrode and a control electrode;

wherein the anode of the light emitting component is connected to the high level signal terminal and connected to the driving module, and the cathode of the light emitting component is connected to the driving module; and wherein the control electrode of the first switching component is connected to the first signal terminal, the first electrode of the first switching component is connected to the low level signal terminal, and the second electrode of the first switching component is connected to the driving module.

3. The pixel driving circuit according to claim 2, wherein the driving module comprises a second driving component including a first electrode, a second electrode and a control electrode, and a third switching component including a first electrode, a second electrode and a control electrode;

wherein the control electrode of the second driving component is connected to the compensation module, the first electrode of the second driving component is connected to the second electrode of the third switching component and the cathode of the light emitting component, and the second electrode of the second driving component is connected to the initialization module; and wherein the control electrode of the third switching component is connected to the second signal terminal, and the first electrode of the third switching component is connected to the high level signal terminal and the anode of the light emitting component.

4. The pixel driving circuit according to claim 3, wherein the compensation module comprises a fourth switching component including a first electrode, a second electrode and a control electrode, a fifth switching component including a first electrode, a second electrode and a control electrode, a sixth switching component including a first electrode, a second electrode and a control electrode, and an energy storage element including a first electrode and a second electrode;

wherein the control electrode of the fourth switching component is connected to the scanning signal terminal and the control electrode of the fifth switching component, the first electrode of the fourth switching component is connected to the data voltage terminal, and the second electrode of the fourth switching component is connected to the first electrode of the energy storage element and the second electrode of the sixth switching component;

wherein the first electrode of the fifth switching component is connected to the reference voltage terminal, and the second electrode of the fifth switching component is connected to the first electrode of the sixth switching component and the control electrode of the second driving component in the driving module;

wherein the control electrode of the sixth switching component is connected to the third signal terminal; and wherein the second electrode of the energy storage element is connected to the second electrode of the second driving component in the driving module and the initialization module.

5. The pixel driving circuit according to claim 2, wherein the light emitting component is an organic light emitting diode.

6. The pixel driving circuit according to claim 1, wherein the initialization module includes a seventh switching component having a first electrode, a second electrode and a control electrode; and wherein the control electrode of the seventh switching component is connected to the fourth signal terminal, the first electrode of the seventh switching component is connected to the driving module and the compensation module, and the second electrode of the seventh switching component is connected to the initial voltage terminal.

7. A display device comprising one or more pixel units and the pixel driving circuit according to claim 1.

8. A method for driving the pixel driving circuit according to claim 1, the method comprising:

in a first phase of displaying each frame of image, turning on the initialization module to initiate the driving module and the compensation module;

in a second phase of displaying each frame of image, compensating a threshold voltage of the driving module when the initialization module is turned off; and in a third phase of displaying each frame of image, driving the light emitting unit to emit light when the initialization module is turned off.

9. The pixel driving circuit according to claim 1, wherein the driving unit is a first driving unit, the pixel driving circuit further comprises a second driving unit including a driving module, a compensation module and an initialization module, the light emitting unit is connected to the first driving unit and the second driving unit, and is configured to emit light under the control of the first driving unit, the second driving unit, the high level signal terminal, the low level signal terminal and the first signal terminal;

wherein the driving module of the second driving unit is connected to a second signal terminal, the initialization module of the second driving unit is connected to a fourth signal terminal, the compensation module of the second driving unit is connected to a scanning signal terminal, a data signal terminal, and a third signal terminal;

wherein the first driving unit is configured to drive the light emitting unit to emit light when the N-th frame of image is displayed;

wherein the second driving unit is configured to drive the light emitting unit to emit light when the N+1st frame of image is displayed; and wherein N is a natural number, and the N-th frame of image and the first N+1st frame of image are two adjacent frames of image.

10. A pixel driving circuit comprising a light emitting unit, a first driving unit and a second driving unit, each of the first driving unit and the second driving unit comprising a driving module, a compensation module and an initialization module;

wherein the light emitting unit is connected to the first driving unit and the second driving unit, a high level signal terminal, a low level signal terminal and a first signal terminal, and is configured to emit light under the control of the first driving unit, the second driving unit, the high level signal terminal, the low level signal terminal and the first signal terminal;

wherein the driving module of the first driving unit is connected to the light emitting unit, the compensation module of the first driving unit, the initialization module of the first driving unit and a second signal terminal of the first driving unit, and is configured to drive the light emitting unit to emit light under the control of the second signal terminal of the first driving unit;

wherein the initialization module of the first driving unit is connected to the light emitting unit, the driving module of the first driving unit, the compensation module of the first driving unit, an initial voltage terminal of the first driving unit and a fourth signal terminal of the first driving unit, and is configured to initiate the driving module of the first driving unit via the initial voltage terminal of the first driving unit under the control of the fourth signal terminal of the first driving unit;

wherein the compensation module of the first driving unit is connected to the driving module of the first driving unit, the initialization module of the first driving unit, a reference voltage terminal of the first driving unit, a scanning signal terminal of the first driving unit, a data voltage terminal of the first driving unit and a third signal terminal of the first driving unit, and is configured to compensate a threshold voltage of the driving module of the first driving unit under the control of the reference voltage terminal of the first driving unit, the scanning signal terminal of the first driving unit, the data voltage terminal of the first driving unit and the third signal terminal of the first driving unit;

wherein the driving module of the second driving unit is connected to the light emitting unit, the compensation module of the second driving unit, the initialization module of the second driving unit and a second signal terminal of the second driving unit, and is configured to drive the light emitting unit to emit light under the control of the second signal terminal of the second driving unit;

wherein the initialization module of the second driving unit is connected to the light emitting unit, the driving module of the second driving unit, the compensation module of the second driving unit, an initial voltage terminal of the second driving unit and a fourth signal terminal of the second driving unit, and is configured to initiate the driving module of the second driving unit via the initial voltage terminal of the second driving unit under the control of the fourth signal terminal of the second driving unit;

wherein the compensation module of the second driving unit is connected to the driving module of the second driving unit, the initialization module of the second driving unit, a reference voltage terminal of the second driving unit, a scanning signal terminal of the second driving unit, a data voltage terminal of the second driving unit and a third signal terminal of the second driving unit, and is configured to compensate a threshold voltage of the driving module of the second driving unit under the control of the reference voltage terminal of the second driving unit, the scanning signal terminal of the second driving unit, the data voltage terminal of the second driving unit and the third signal terminal of the second driving unit;

wherein the first driving unit is configured to drive the light emitting unit to emit light when the N-th frame of image is displayed;

wherein the second driving unit is configured to drive the light emitting unit to emit light when the N+1st frame of image is displayed; and wherein N is a natural number, and the N-th frame of image and the first N+1st frame of image are two adjacent frames of image.

11. The pixel driving circuit according to claim 10, wherein the light emitting unit includes a light emitting component having an anode and a cathode and a first switching component having a first electrode, a second electrode and a control electrode;

wherein the anode of the light emitting component is connected to the high level signal terminal and connected to the driving module of the first driving unit and the driving module of the second driving unit, and the cathode of the light emitting component is connected to the driving module of the first driving unit and the driving module of the second driving unit; and wherein the control electrode of the first switching component is connected to the first signal terminal, the first electrode of the first switching component is connected to the low level signal terminal, and the second electrode of the first switching component is connected to the driving module of the first driving unit and the driving module of the second driving unit.

12. The pixel driving circuit according to claim 11, wherein the driving module of the first driving unit comprises a second driving component including a first electrode, a second electrode and a control electrode and a third switching component including a first electrode, a second electrode and a control electrode;

wherein the control electrode of the second driving component is connected to the compensation module of the first driving unit, the first electrode of the second driving component of the first driving unit is connected to the second electrode of the third switching component of the first driving unit and the cathode of the light emitting component, and the second electrode of the second driving component of the first driving unit is connected to the initialization module of the first driving unit; and wherein the control electrode of the third switching component of the first driving unit is connected to the second signal terminal of the first driving unit, and the first electrode of the third switching component of the first driving unit is connected to the high level signal terminal and the anode of the light emitting component.

13. The pixel driving circuit according to claim 12, wherein the compensation module of the first driving unit comprises a fourth switching component including a first electrode, a second electrode and a control electrode, a fifth switching component including a first electrode, a second electrode and a control electrode, a sixth switching component including a first electrode, a second electrode and a control electrode and an energy storage element including a first electrode and a second electrode;

wherein the control electrode of the fourth switching component is connected to the scanning signal terminal and the control electrode of the fifth switching component of the first driving unit, the first electrode of the fourth switching component is connected to the data voltage terminal of the first driving unit, and the second electrode of the fourth switching component is connected to the first electrode of the energy storage element and the second electrode of the sixth switching component;

wherein the first electrode of the fifth switching component is connected to the reference voltage terminal of the first driving unit, the second electrode of the fifth switching component is connected to the first electrode of the sixth switching component and the control electrode of the second driving component in the driving module of the first driving unit;

wherein the control electrode of the sixth switching component is connected to the third signal terminal of the first driving unit; and wherein the second electrode of the energy storage element is connected to the second electrode of the second driving component in the driving module of the first driving unit and the initialization module of the first driving unit.

14. The pixel driving circuit according to claim 11, wherein the driving module of the second driving unit comprises a second driving component including a first electrode, a second electrode and a control electrode and a third switching component including a first electrode, a second electrode and a control electrode;

wherein the control electrode of the second driving component is connected to the compensation module of the second driving unit, the first electrode of the second driving component of the second driving unit is connected to the second electrode of the third switching component of the second driving unit and the cathode of the light emitting component, and the second electrode of the second driving component of the second driving unit is connected to the initialization module of the second driving unit; and wherein the control electrode of the third switching component of the second driving unit is connected to the second signal terminal of the second driving unit, and the first electrode of the third switching component of the second driving unit is connected to the high level signal terminal and the anode of the light emitting component.

15. The pixel driving circuit according to claim 14, wherein the compensation module of the second driving unit comprises a fourth switching component including a first electrode, a second electrode and a control electrode, a fifth switching component including a first electrode, a second electrode and a control electrode, a sixth switching component including a first electrode, a second electrode and a control electrode and an energy storage element including a first electrode and a second electrode;

wherein the control electrode of the fourth switching component is connected to the scanning signal terminal of the second driving unit and the control electrode of the fifth switching component, the first electrode of the fourth switching component is connected to the data voltage terminal of the second driving unit, and the second electrode of the fourth switching component is connected to the first electrode of the energy storage element and the second electrode of the sixth switching component;

wherein the first electrode of the fifth switching component is connected to the reference voltage terminal of the second driving unit, the second electrode of the fifth switching component is connected to the first electrode of the sixth switching component and the control electrode of the second driving component in the driving module of the second driving unit;

wherein the control electrode of the sixth switching component is connected to the third signal terminal of the second driving unit; and wherein the second electrode of the energy storage element is connected to the second electrode of the second driving component in the driving module of the second driving unit and the initialization module of the second driving unit.

16. The pixel driving circuit according to claim 11, wherein the light emitting component is an organic light emitting diode.

17. The pixel driving circuit according to claim 10, wherein the initialization module of the first driving unit includes a seventh switching component having a first electrode, a second electrode and a control electrode; and wherein the control electrode of the seventh switching component is connected to the fourth signal terminal of the first driving unit, the first electrode of the seventh switching component is connected to the driving module of the first driving unit and the compensation module of the first driving unit, and the second electrode of the seventh switching component is connected to the initial voltage terminal of the first driving unit.

18. The pixel driving circuit according to claim 10, wherein the initialization module of the second driving unit includes a seventh switching component including a first electrode, a second electrode and a control electrode; and wherein the control electrode of the seventh switching component is connected to the fourth signal terminal of the second driving unit, the first electrode of the seventh switching component is connected to the driving module of the second driving unit and the compensation module of the second driving unit, and the second electrode of the seventh switching component is connected to the initial voltage terminal of the second driving unit.

19. A display device comprising a plurality of pixel units and the pixel driving circuit according to claim 10.

20. A method for driving the pixel driving circuit according to claim 10, the method comprising:

in a first phase of displaying the N-th frame of image, turning on the initialization module of the first driving unit to initiate the driving module of the first driving unit and the compensation module of the first driving unit;

in a second phase of displaying the N-th frame of image, compensating, with the compensation module of the first driving unit, the threshold voltage of the driving module of the first driving unit when the initialization module of the first driving unit is turned off;

in a third phase of displaying the N-th frame of image, driving, with the driving module of the first driving unit, the light emitting unit to emit light when the initialization module of the first driving unit is turned off;

in a first phase of displaying the N+1st frame of image, turning on the initialization module of the second driving unit to initiate the driving module of the second driving unit and the compensation module of the second driving unit;

in a second phase of displaying the N+1st frame of image, compensating, with the compensation module of the second driving unit, the threshold voltage of the driving module of the second driving unit when the initialization module of the second driving unit is turned off; and in a third phase of displaying the N+1st frame of image, driving, with the driving module of the second driving unit, the light emitting unit to emit light when the initialization module of the second driving unit is turned off.

* * * * *